US008931243B2

(12) United States Patent
Guglielmini et al.

(10) Patent No.: US 8,931,243 B2
(45) Date of Patent: Jan. 13, 2015

(54) HOT-FILL METHOD

(75) Inventors: Bernard Guglielmini, Aigues Mortes (FR); Jean-Yves Rognard, Marcy-sur-Anse (FR)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 13/195,608

(22) Filed: Aug. 1, 2011

(65) Prior Publication Data

US 2011/0283665 A1 Nov. 24, 2011

Related U.S. Application Data

(63) Continuation of application No. 12/256,636, filed on Oct. 23, 2008, now abandoned.

(51) Int. Cl.

| | |
|---|---|
| ***B65B 55/12*** | (2006.01) |
| ***B67B 3/20*** | (2006.01) |
| ***B65D 47/26*** | (2006.01) |
| ***B65D 47/08*** | (2006.01) |
| ***B65D 47/20*** | (2006.01) |
| ***B65D 51/00*** | (2006.01) |

(52) U.S. Cl.

CPC ..... *B65D 47/0833* (2013.01); *B65D 47/0838* (2013.01); *B65D 47/2031* (2013.01); *B65D 51/00* (2013.01); *B65D 2101/0038* (2013.01)

USPC ..... 53/420; 53/440; 53/471; 53/490

(58) Field of Classification Search

USPC ..... 53/331.5, 410, 471, 478, 484, 490, 420, 53/440, 127, 133.1, 133.2

See application file for complete search history.

(56) References Cited

U.S. PATENT DOCUMENTS

| | | | | |
|---|---|---|---|---|
| 5,251,424 | A * | 10/1993 | Zenger et al. | 53/431 |
| 5,271,531 | A * | 12/1993 | Rohr et al. | 222/212 |
| 6,409,054 | B1 * | 6/2002 | Garibaldi | 222/524 |
| 6,419,101 | B1 * | 7/2002 | Hessel et al. | 215/253 |
| 6,619,016 | B1 * | 9/2003 | Sindermann et al. | 53/432 |
| 7,011,221 | B2 * | 3/2006 | Smith et al. | 215/251 |
| 7,117,654 | B2 * | 10/2006 | Danks | 53/420 |
| 7,373,959 | B2 * | 5/2008 | Edwards et al. | 141/114 |
| 2002/0066713 | A1 | 6/2002 | Ma | |
| 2003/0116522 | A1 | 6/2003 | Julian et al. | |
| 2004/0084104 | A1 * | 5/2004 | Raniwala | 141/9 |
| 2005/0126118 | A1 * | 6/2005 | Till | 53/167 |
| 2007/0114202 | A1 * | 5/2007 | Lee | 215/311 |
| 2007/0181525 | A1 | 8/2007 | Gregory et al. | |
| 2011/0017736 | A1 | 1/2011 | Guglielmini | |

FOREIGN PATENT DOCUMENTS

| | | | | |
|---|---|---|---|---|
| EP | 1 582 475 | | 10/2005 | |
| FR | 2717778 | A1 * | 9/1995 | B65D 51/16 |
| GB | 2433496 | A * | 6/2007 | B65D 47/08 |
| WO | 91/03404 | | 3/1991 | |
| WO | 00/17092 | | 3/2000 | |

* cited by examiner

*Primary Examiner* — Stephen F Gerrity

(74) *Attorney, Agent, or Firm* — McAndrews, Held & Malloy Ltd.

(57) ABSTRACT

The present invention relates generally to a closure and particularly to a closure of the type known as a sport cap.

20 Claims, 6 Drawing Sheets

HOT-FILL METHOD

The present application is filed as a continuation application of U.S. patent application Ser. No. 12/256,636, now abandoned, which was filed Oct. 23, 2008. The entire text of the aforementioned application is incorporated herein by reference in its entirety.

FIELD OF THE INVENTION

The present invention relates generally to a closure and particularly to a closure of the type known as a sport cap.

BACKGROUND OF THE INVENTION

In recent times the use of so-called sport caps has increased. Sport caps differ from the more traditional so-called single caps in that they have two areas of sealing: i) between the closure and the container neck (which single caps have); and ii) between two parts of the closure. The two parts of the closure may include, for example, a spout and a lid or a push-pull spout and a base.

Hotfill is a filling technique in which containers are filled with product at process temperature, hot, to ensure continued sterility of the container and the product during and after the fill process. When such containers are capped the closure must be suitable for application.

It is known to provide closures having two or more components, such as a body and a spout. In many cases it is necessary for extraneous fluid to be applied to such closures. For example, cooling or cleaning fluid is sprayed onto closures during the manufacturing process. It is difficult to produce closures which can reliably prevent the ingress of water between various parts of a body and an insert. The result is that the fluid can become trapped within the closure which is undesirable.

SUMMARY OF THE INVENTION

The present invention seeks to address the problems with known sports cap closures.

According to a first aspect of the present invention there is provided a linerless, hotfill, sports cap closure.

According to a second aspect of the present invention there is provided a hotfill sports cap closure comprising a body having two or more parts and two or more sealing areas, the first sealing area being sealable to a container neck and the second sealing area being between two body parts.

According to a further aspect of the present invention there is provided a hotfill sports cap closure comprising a body formed with an absence of a sealing liner, and having a base with a spout, and a lid for sealing the spout.

The closure comprises a single piece. For example a base may be formed with an integral spout and an integrally formed lid may be provided.

Alternatively the closure may be formed from two or more separate components. For example, the closure may comprise a body and an insert. Such closure may have a drainage system for allowing fluid applied to the closure to pass between the exterior of the insert and the interior of the body to allow removal thereof.

According to a further aspect of the present invention there is provided a closure comprising a body and an insert, and having a drainage system for allowing fluid applied to the closure to pass between the exterior of the insert and the interior of the body to allow removal thereof.

By providing a drainage system the closure is particularly, although not exclusively, suitable for hotfill applications in which spraying of the closure following capping for cooling and/or sterilisation purposes is common.

The drainage system may comprise one or more drainage paths formed at the interface between the insert and the body.

The drainage path/s may be formed wholly or partly in either or both of the body and the insert.

In some embodiments, each drainage path may comprise one or more slots formed at the periphery of the insert.

The insert may comprise a plurality of ribs or radial projections at its periphery. The slots may be formed between the ribs.

The one or more slots may comprise an inclined drainage face to assist drainage.

The insert may comprise a plurality of mutually spaced retention spokes. The spokes may define, at least in part, the drainage paths.

The insert may comprise a spout. For example, a drinking spout would require sterilisation with a cleaning fluid and thereafter the fluid needs to be removed so as not to affect the user's taste.

The body of closure formed according to the present invention may comprise a base and a lid. The base and lid may be joined by a hinge, such as a snap-hinge. The interface between the lid and the base is a likely point at which fluid will enter.

Closure formed according to the present invention may be provided with tamper-evident means.

According to a further aspect there is provided an insert for a closure body, comprising one or more drainage paths for allowing fluid applied to the closure to pass between the exterior of the insert and the interior of the body to allow removal thereof.

BRIEF DESCRIPTION OF THE DRAWINGS

The present invention will now be more particularly described, by way of example, with reference to the accompanying drawings in which.

DETAILED DESCRIPTION OF THE PREFERRED EMBODIMENTS

The present invention describes a linerless, hotfill, sports cap closure. More particularly, the hotfill sports cap closure of the invention is one which comprises a body having two or more pads and two or more sealing areas, the first sealing area being sealable to a container neck and the second sealing area being between two body parts. The sports cap closure is one that is without a sealing liner, and preferably has a base with a spout, and a lid for sealing the spout.

In some embodiments, the closure is a single piece whereas in other embodiments, the closure is made from two or more separate components such as a body and an insert. The closure will preferably have a drainage system that allows fluid to be passed between the exterior of the insert and the interior of the body.

The drainage system in the closure is useful in that it allows spraying of the closure in for example hotfill applications in which it is desirable to spray the closure following capping for cooling and/or sterilisation purposes.

The drainage system may comprise one or more drainage paths formed at the interface between the insert and the body. These drainage paths may be located either wholly or partly in the body of the closure, partly or wholly in the insert of the closure, or partly or wholly in both the insert and the body of the closure.

The drainage paths may be configured to comprise one or more slots formed at the periphery of the insert. For example, the insert may contain a plurality of ribs or radial projections at its periphery and the slots may be formed between the ribs. Drainage may be facilitated by configuring one or more of said slots to comprise an inclined drainage face. The insert may also comprise a plurality of retention spokes which may define at least in part, the drainage paths for the closure. The retention spokes preferably are evenly spaced.

The insert may comprise a spout, e.g. a drinking spout would require sterilisation with a cleaning fluid and thereafter the fluid needs to be removed so as not to affect the user's taste.

The body of the closure may comprise a base and a lid. Preferably the base and lid are joined by a hinge, such as a snap-hinge. The interface between the lid and the base is a likely point at which fluid will enter. The closure also may be provided with a device to show tampering.

In a preferred closure there is provided an insert that comprises one or more drainage paths for allowing fluid applied to the closure to pass between the exterior of the insert and the interior of the body to allow removal of the fluid.

Figure 1:
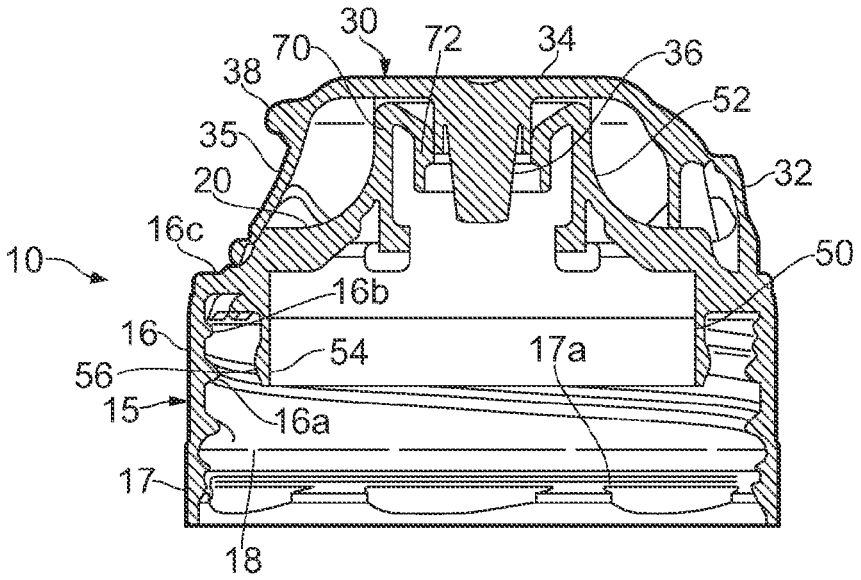
FIG. 1 is a section of a closure formed according to an embodiment of the present invention.
Figure 2:
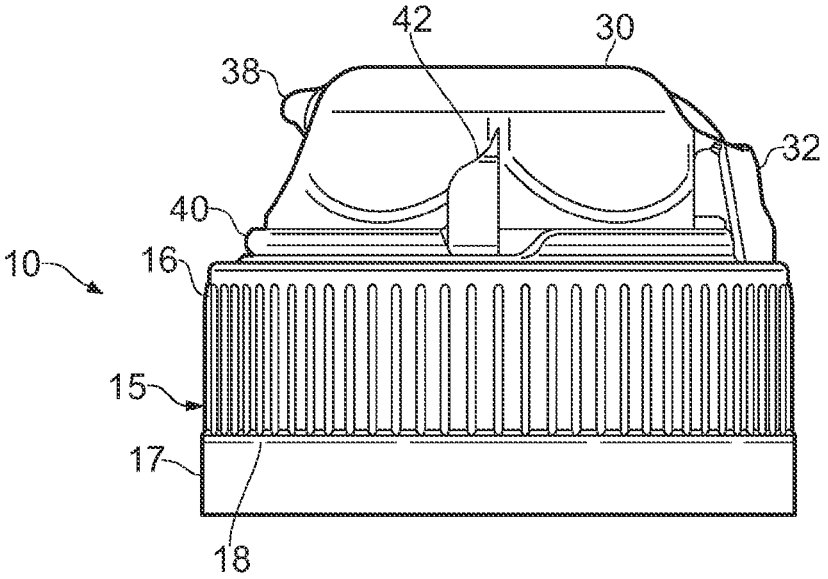
FIG. 2 is a side elevation of the closure of FIG. 1.

The above aspects of the invention are depicted in the attached drawings. Referring first to FIGS. 1 and 2 there is shown a sports cap closure generally indicated 10. The closure 10 comprises a body with a base 15 and a lid 30.

The base 15 comprises a generally cylindrical side wall 16 having at one end a tamper-evident annular ring 17 connected thereto by a plurality of frangible bridges 18.

The side wall 16 terminates at its end opposite the band 17 with an annular shoulder 16*c* which extends radially inwards. A generally turret-like lid 30 is connected to the free end of the shoulder 16*c* via a hinge 32.

The interior of the side wall 16 comprises internal screw thread formations 16*a* for engaging corresponding external screw thread formations on a container neck. The interior of the side wall 16 further comprises an annular retention bead 16*b*.

The interior of the band 17 comprises a plurality of upturned flaps 17*a* for engagement under a locking bead on a container neck so that if the closure is unscrewed the band will remain on a container neck.

The lid 30 is generally frustoconical and comprises a generally circular top plate 34 from the centre of which depends a spigot 36 and from the periphery of which depends an inclined sidewall 35. Opposite the hinge 32 the lid 30 includes a small peak 38 used to lift the lid and flip it open with respect to the base 15.

A tamper-evident strip 40 is frangibly connected between the lid 30 and the base 15. The strip 40 terminates with a tab 42 at either end to allow it to be torn away prior to first opening of the lid.

The base includes a spout portion 20 which extends from the shoulder 16*c*. The spout 20 comprises a generally cylindrical lower portion 50 and a generally frustoconical upper portion 52. The upper portion 52 comprises a curved, generally frustoconical outer surface defining a spout. The lower portion 50 comprises an annular sealing part 54 having an external sealing bead 56. In use, the sealing part 54 enters a container neck such that the sealing bead 56 seals against its inner surface. At the end of the spout side wall opposite the lower portion 50 is a cylindrical terminal portion 70. An annular orifice wall 72 extends inwards from the free end of the portion 70 and defines an orifice. In the closed position of the closure shown the orifice is sealed by the lid spigot 36.

It is to be noted that the closure as a whole is formed without a liner. In use the closure 10 can be applied to a hot-filled container neck.

Figure 3:
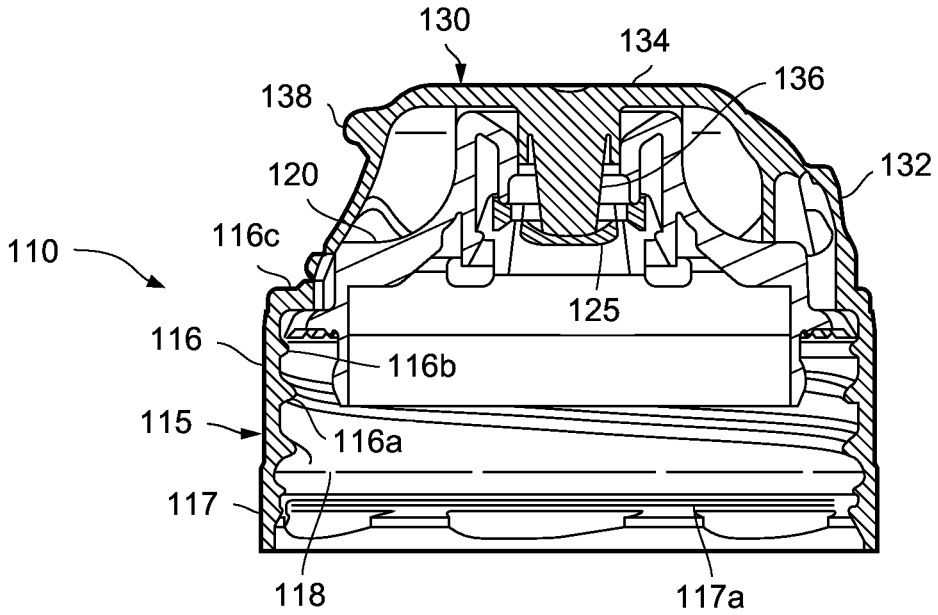
FIG. 3 is a section of a closure formed according to an alternative embodiment of the present invention.
Figure 4:
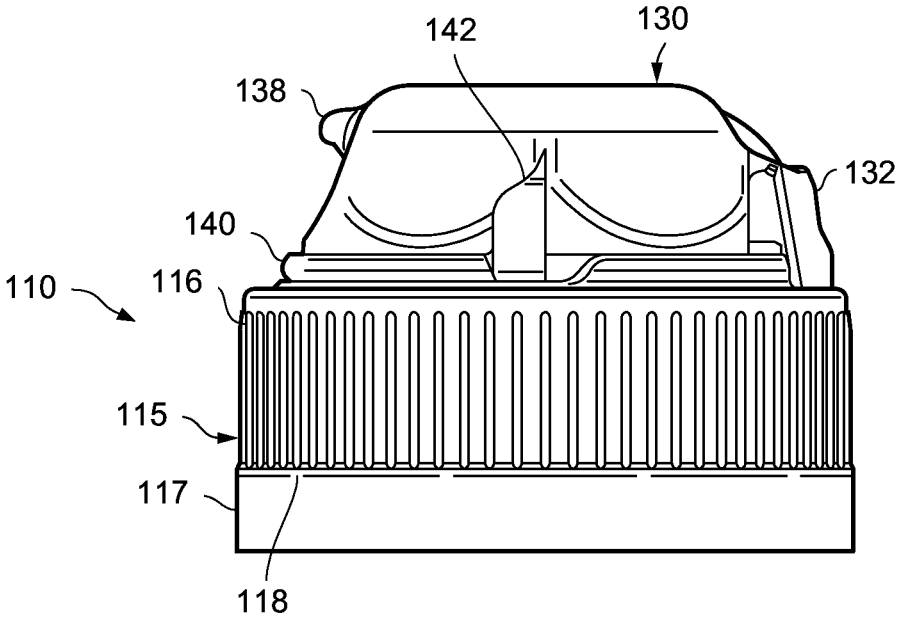
FIG. 4 is a side elevation of the closure of FIG. 3.
Figure 5A:
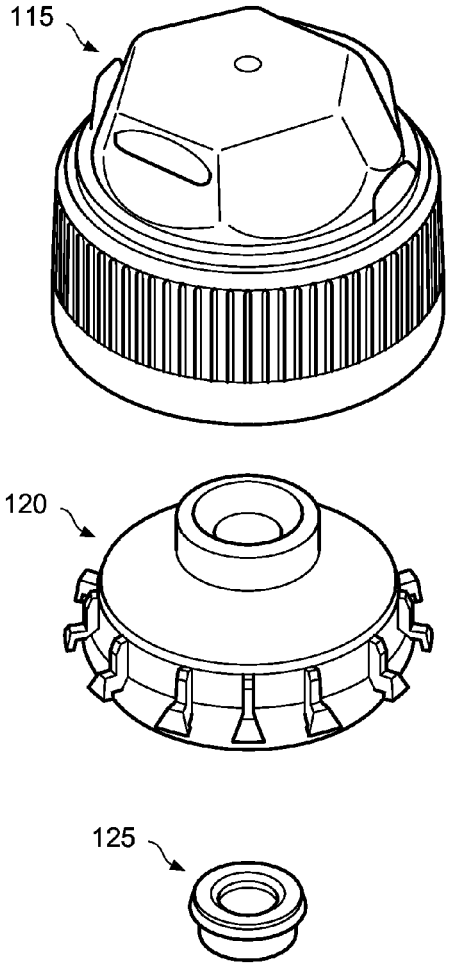
FIG. 5*a* is an exploded perspective view of the components making up the closure of FIGS. 3 and 4.
Figure 5B:
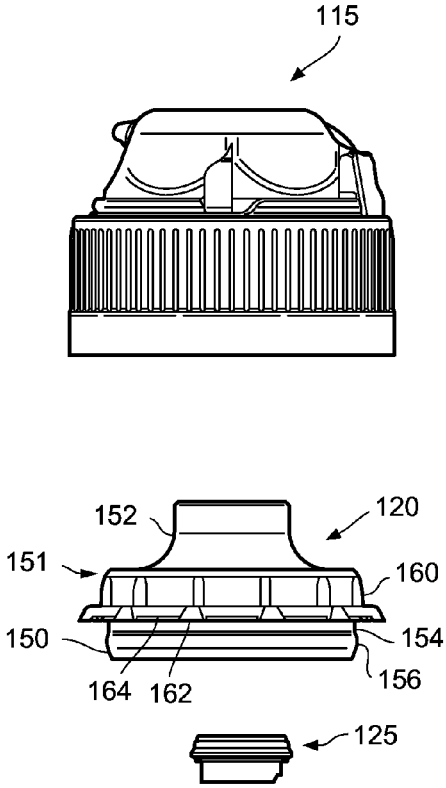
FIG. 5*b* is a side elevation of the view of FIG. 5*a;*

Referring now to FIGS. 3 to 5 there is shown a closure generally indicated 110. The closure 110 comprises a body 115, a spout insert 120 and a self-closing valve assembly 125.

The body 115 comprises a generally cylindrical side wall 116 having at one end a tamper-evident annular ring 117 connected thereto by a plurality of frangible bridges 118.

The side wall 116 terminates at its end opposite the band 117 with an annular shoulder 116*c* which extends radially inwards. A generally turret-like lid 130 is connected to the free end of the shoulder 116*c* via a hinge 132.

The interior of the side wall 116 comprises internal screw thread formations 116*a* for engaging corresponding external screw thread formations on a container neck. The interior of the side wall 116 further comprises an annular retention bead 116*b*.

The interior of the band 117 comprises a plurality of upturned flaps 117*a* for engagement under a locking bead on a container neck so that if the closure is unscrewed the band will remain on a container neck.

The lid 130 comprises a generally hexagonal top plate 134 from which depends a spigot 136. Opposite the hinge 132 the lid 130 includes a small peak 138 used to lift the lid and flip it open with respect to the base 115.

A tamper-evident strip 140 is frangibly connected between the lid 130 and the base 115. The strip 140 terminates with a tab 142 at either end to allow it 10 be torn away prior to first opening of the lid.

Figure 6:
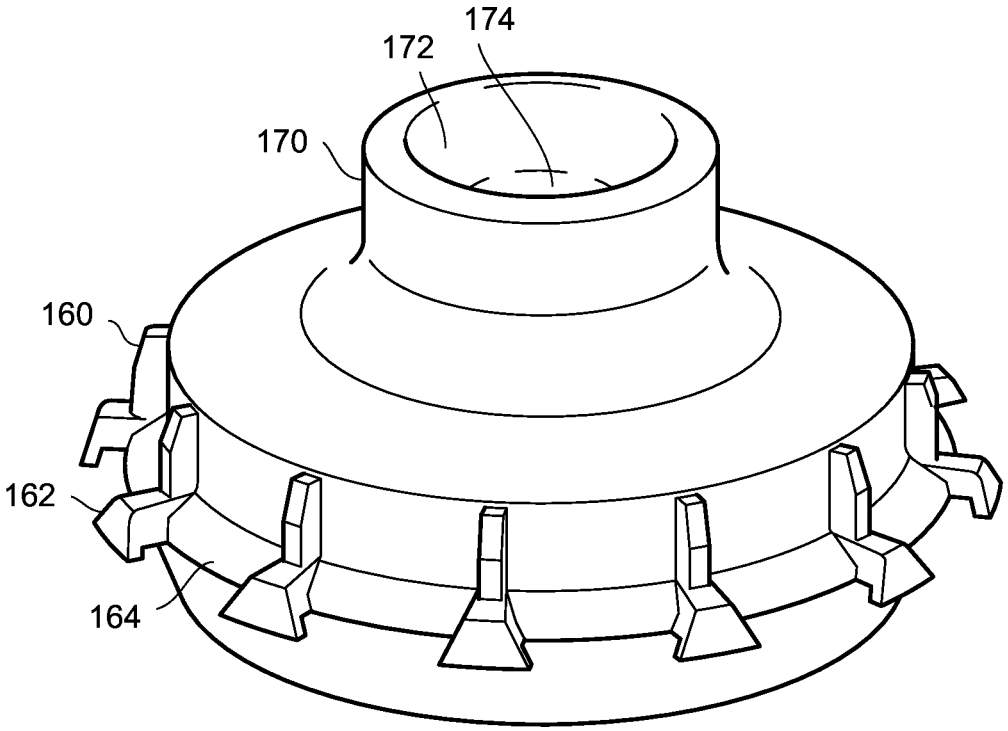
FIG. 6 is a perspective view of a spout insert forming part of the closure of FIGS. 3 to 5.

Referring now also to FIGS. 5-6, the spout 120 comprises a generally cylindrical lower portion 150, a generally cylindrical central portion 151 and a generally frusto conical upper portion .

Figure 7:
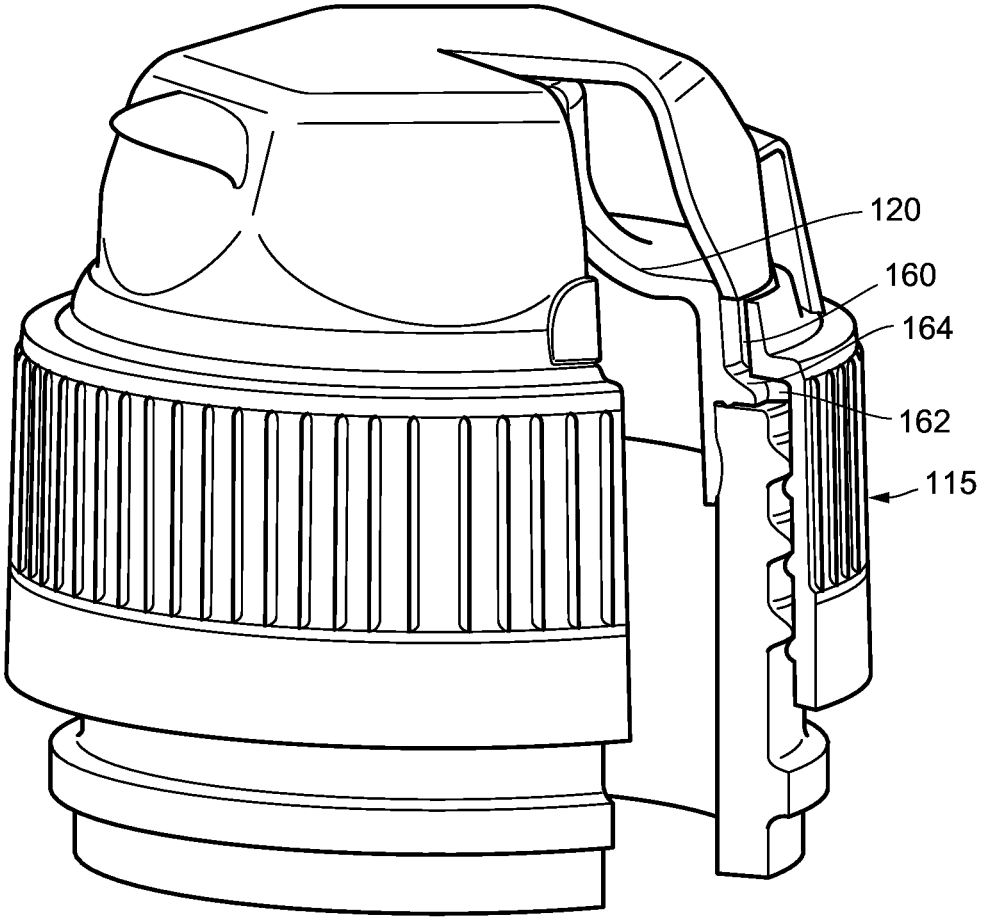
FIG. 7 is a perspective view of the closure of FIGS. 3 to 6 shown with a cut-out section illustrating the internal structure.
Figure 8:
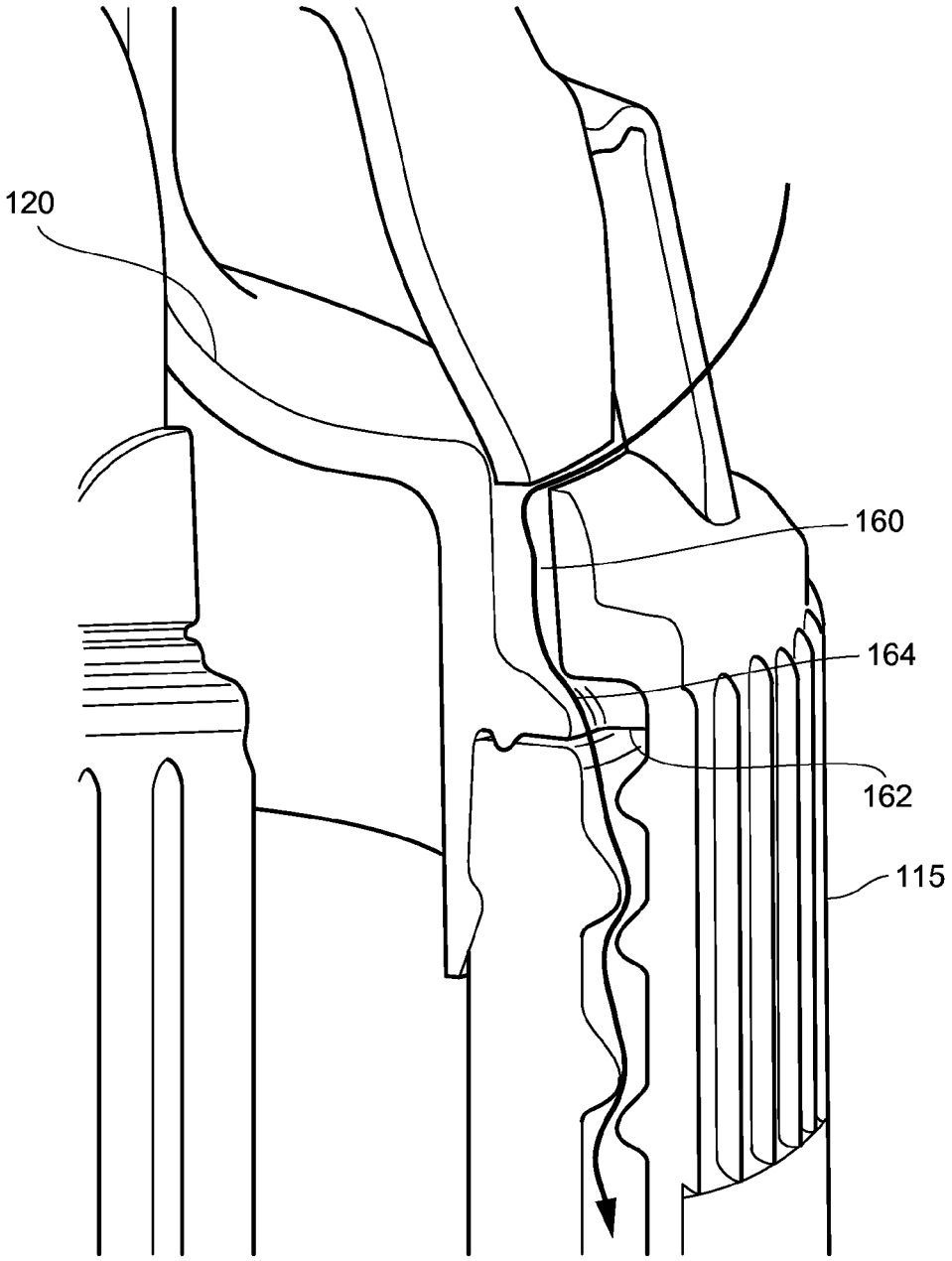
FIG. 8 is a magnified view of the cut-out section of FIG. 7.

The lower portion 150 comprises an annular sealing part 154 having an external sealing bead 156. In use, the sealing part 154 enters a container neck such that the sealing bead 156 seals against its inner surface (as shown in FIGS. 7 and 8).

The central retention portion 151 comprises an annular base 158 from which project a plurality of spaced axial ribs 160 which are used to secure the insert 120 in the body 115.

The base 158 further includes a plurality of radially outwardly extending retention spokes 162 positioned at the bottom of each rib 160. Between each spoke 162 is an inclined ledge 164 which extends radially outwardly approximately the same extent as the ribs 160. The spokes 162 are generally L-shape with the shorter leg projecting away from the upper portion 152.

As shown in FIG. 3, the upper portion 152 comprises a curved, generally frusta conical outer surface defining a spout. At the and of the spout side wall opposite the central portion 151 is a cylindrical terminal portion 170. An annular orifice wall 172 extends inwards from the free end of the portion 170 and defines an orifice 174. An annular retention bead 176 depends internally from the base of the terminal portion.

The self-closing valve assembly 125 comprises a body 126 and a valve 127. This structure is itself known from the Applicant's international Patent Application No PCT/EP2005/053917. The valve body 125 includes a retention bead 128 which clips over the spout retention bead. The valve assembly 125 is received between the retention bead 176 and the annular wail 172 as shown best in FIG. 3.

Referring now also to FIGS. 7 and 8, the spout 120 is received into the body 115. The retention spokes 162 engage over the retention bead 116*b* and the ribs 160 fit tightly within the orifice defined by the shoulder 1160 so that the spout is held firmly in position. The ribs 160 also fit tightly within the lid 130 to hold it in the closed position. The spigot 136 enters the orifice 174 and abuts against the valve 127 to prevent it from opening with the lid closed.

As will be appreciated by referring to FIGS. 6 to 8, with the insert 120 in position slots are formed between the spokes 162 and ledges 164 of the central portion 151 and the side wail 116. Furthermore, a passage between the lid 130 and the base 158 is established by the ribs 160.

As illustrated in FIG. 8, when fluid is sprayed at the closure 110, it may enter the interior of the closure via the hinge line interface between the lid 130 and the base 115. If this happens, the fluid can pass between the ribs 160 and down over the ledges 164 before passing through the slots and then between the closure and container screw threads and out at the bottom of the side wall 116. This means that there is an unobstructed drainage path for fluid to follow if it enters the closure. It may be necessary to force fluid through the drainage path, for example by blowing air at the closure.

The invention claimed is:

1. A method of providing a hot-filled container capped with a sports cap, comprising the steps of:

providing a container having a neck, the neck having an inner surface;

filling the container with product at process temperature, hot, to ensure sterility;

providing a linerless, hotfill sports cap closure including a body with a side wall including internal screw thread formations to engage corresponding external screw thread formations on the neck of the container; the body also having a base; a lid; and a spout, the base and lid being connected via a hinge, the body comprising a generally cylindrical lower portion, the lower portion comprising an annular sealing part having an external sealing bead; and sealing the sports cap on the container in the absence of a sealing liner by capping the closure onto the container so that the annular sealing part enters the neck of the container such that the sealing bead seals against the inner surface of the neck.

2. A method as claimed in claim 1, and further comprising the step of spraying the closure with fluid following capping for cooling and/or sterilisation purposes.

3. A method as claimed in claim 2, further comprising the step of providing the closure with a drainage system to allow removal of fluid therefrom.

4. A method as claimed in claim 3, further comprising the step of forcing fluid through the drainage system.

5. A method as claimed in claim 4, in which air is blown at the closure to force fluid through the drainage system.

6. A method of claim 5, in which the spout is formed as an insert.

7. A method as claimed in claim 6, in which the drainage system provides one or more drainage paths between the spout and the base for allowing removal of fluid entering between the base and the lid.

8. A method of claim 2, in which the spout is formed as an insert.

9. A method as claimed in claim 8, in which the closure includes a drainage system and the drainage system provides one or more drainage paths between the spout and the base for allowing removal of fluid entering between the base and the lid.

10. A method of claim 3, in which the spout is formed as an insert.

11. A method as claimed in claim 10, in which the drainage system provides one or more drainage paths between the spout and the base for allowing removal of fluid entering between the base and the lid.

12. A method of claim 4, in which the spout is formed as an insert.

13. A method as claimed in claim 12, in which the drainage system provides one or more drainage paths between the spout and the base for allowing removal of fluid entering between the base and the lid.

14. A method of claim 1, in which the spout is formed as an insert.

15. A method as claimed in claim 14, in which the closure includes a drainage system and the drainage system provides one or more drainage paths between the spout and the base for allowing removal of fluid entering between the base and the lid.

16. The method according to claim 1, wherein the cylindrical lower portion is formed integrally on the base.

17. The method according to claim 1, wherein the cylindrical lower portion is formed integrally on the spout.

18. A method of providing a hot-filled container capped with a sportscap, comprising the steps of:

providing a container having a neck, the neck having an inner surface;

filling the container with product at process temperature, hot, to ensure sterility;

providing a linerless, hotfill sports cap closure including a body with a side wall including internal screw thread formations to engage corresponding external screw thread formations on the neck of the container; the body also including a base; a lid; and a spout, the base and lid being connected via a hinge, the body comprising a generally cylindrical lower portion, the lower portion comprising an annular sealing part having an external sealing bead, the body being formed with an absence of a sealing liner; and capping the closure onto the container in the absence of a sealing liner so that the annular sealing part enters the neck of the container such that the sealing bead seals against the inner surface of the neck;

wherein the capping step comprises sealing at a first area of sealing between the closure and the neck of the container and sealing at a second area of sealing between two parts of the sportscap.

19. The method of claim 18 wherein the sealing at the second area includes sealing between the spout and the lid.

20. A method of providing a hot-filled container capped with a sportscap, comprising the steps of:

providing a container having a neck, the neck having an inner surface;

filling the container with product at process temperature, hot, to ensure sterility;

providing a linerless, hotfill sports cap closure including a body with a side wall including internal screw thread formations to engage corresponding external screw thread formations on the neck of the container; the body also including a base; a lid; and a spout, the base and lid being connected via a hinge, the body comprising a generally cylindrical lower portion, the lower portion comprising an annular sealing part having an external sealing bead;

capping the closure onto the container in the absence of a sealing liner so that the annular sealing part enters the neck of the container such that the sealing bead seals against the inner surface of the neck; and spraying the closure with fluid following capping for cooling and/or sterilisation purposes;

wherein the closure comprises a drainage system to allow removal of fluid therefrom.

* * * * *